United States Patent [19]

Vinois

[11] 4,174,005

[45] Nov. 13, 1979

[54] FLUID PRESSURE MEASURING DEVICE

[76] Inventor: Jean-Claude C. L. Vinois, 129, Rue Papenkasteel, Brussels, Belgium

[21] Appl. No.: 849,715

[22] Filed: Nov. 9, 1977

[30] Foreign Application Priority Data

Nov. 10, 1976 [BE] Belgium ..... 848195

[51] Int. Cl.[2] ..... B65C 3/00

[52] U.S. Cl. ..... 141/54; 141/302

[58] Field of Search ..... 141/37, 39–64, 141/95, 99, 198, 291–296, 301–306, 392, 144–152

[56] References Cited

U.S. PATENT DOCUMENTS 3,799,219 3/1974 Uth et al. ..... 141/39

FOREIGN PATENT DOCUMENTS 1004828 9/1965 United Kingdom .

*Primary Examiner*—Houston S. Bell

[57] ABSTRACT

The present invention relates to valves for racking machines which are known as isobarometric machines comprising an upper reservoir which is actuated by a rotational movement and which is provided with a certain number of valve devices or tap devices making it possible to simultaneously fill several containers or bottles.

18 Claims, 11 Drawing Figures

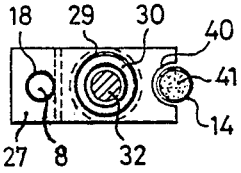
FIG. 1A
FIG. 1B
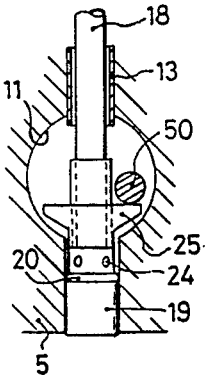
FIG. 1C
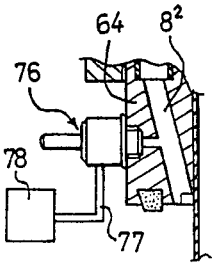
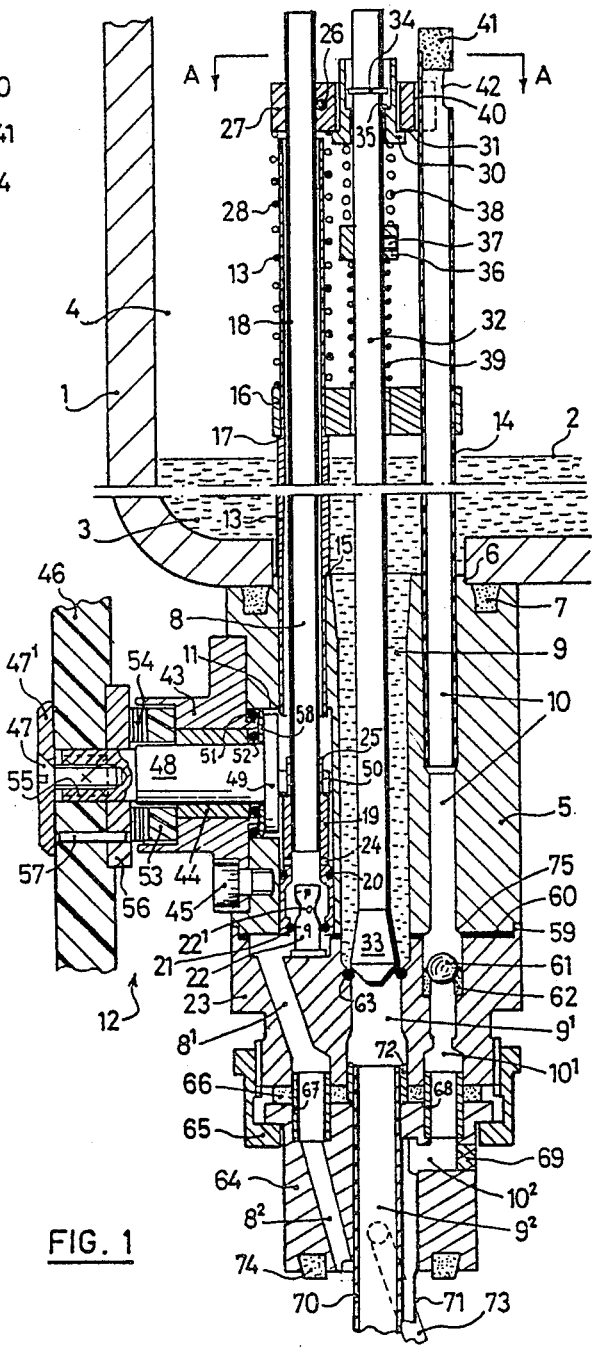
FIG. 1

FIG. 2A
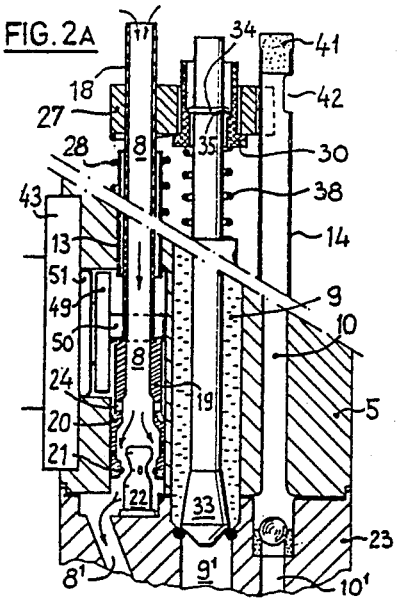
FIG. 2B
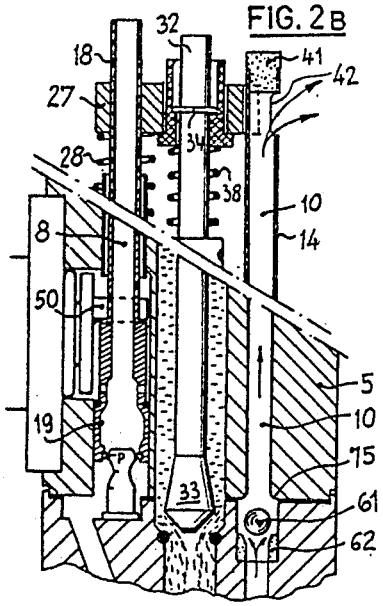
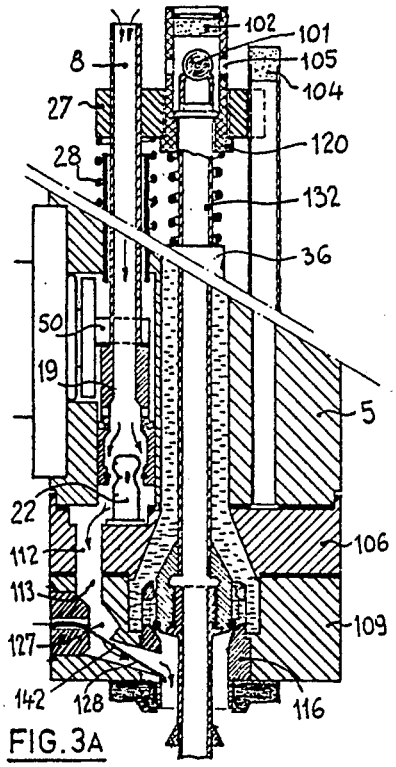
FIG. 3A
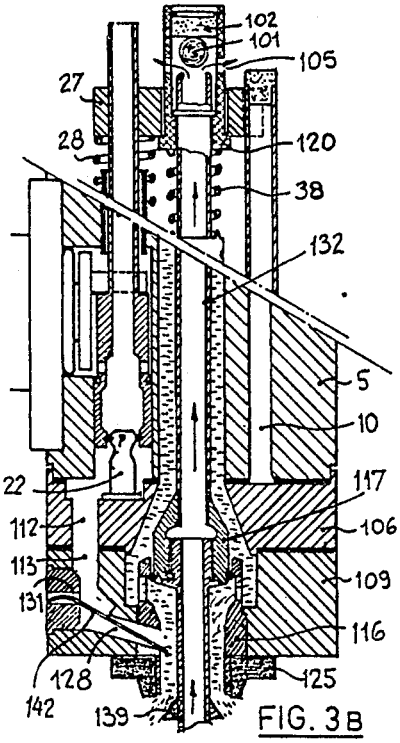
FIG. 3B

FLUID PRESSURE MEASURING DEVICE

These isobarometric racking machines are generally used for the racking of liquid such as beers, lemonade, mineral waters, natural fruit juices, etc., and need filling units having piping which passes through the layer of liquid under charge in order to reach the gaseous region which is maintained under pressure in the upper part of the tank or the reservoir.

In the field of bottling, taking into account modern requirements which are the production and the cost price there is a need to improve the means which make it possible to fill a maximum number of containers per unit of time, with a minimum of material and a minimum of wastage, while taking into account the quality of the product which is being racked.

Generally, it is at the time of its introduction into the bottle, i.e. during the final manipulation, that the liquid is badly treated in such a way as to cause it to lose some of its qualities which have been obtained as a result of the extended and numerous careful measures which have been adhered to during its manufacture.

Whatever type of device for filling is used, the operating mechanism always consists of one or more moveable pieces which act by means of sliding or rotation, in such a way as to connect the pipes to the bottle in a definite order while the successive movements are controlled using a lever or a follower which is operated by exterior cams.

It is appropriate to mention the principle difficulties which are:

Sealing which is difficult to ensure and to maintain;

Sterilisation which is difficult to carry out;

The movement which takes place at a very rapid speed, bringing about in the short term wear and inaccuracies due to friction of the moving parts.

The present invention has the aim of providing a valve which has a simple construction and reliable operation.

The present invention also has the aim of providing a racking valve which;

Occupies a small space and which by virtue of this fact makes it possible to locate a larger number of devices on one tank;

is adaptable to existing machines and to the particular cases of lateral flow or flow by nozzle.

This valve is essentially characterized in that it comprises a body through which there pass vertically three channels one of which is for pressurisation and is an independent pipe which is extended upwardly in the tank through the layer of liquid by means of a tube, in that inside the tube there is provided a tube which is able to slide freely and at the lower extremity of which there is provided a distributing device which consists of a slide valve which extends the tube downwards and is subject to the action of mechanical control and a closure device, this slide valve and this closure device cooperating between themselves in such a way that by means of different successive actions on the slide valve the latter and the closure device may be brought into the relative position of sealing and of passage of gas under pressure and that sliding of the tube (18) can be caused and in that there is provided in the reservoir a mechanical linkage between the sliding tube and means which make up part of a control device for the opening and the flow of liquid in such a way that the movement of the sliding tube may determine opening for flow.

In order to aid the understanding of the invention, two examples of embodiments will be described below which are given by way of non limiting examples and with reference to the drawing in which:

FIG. 1 is a sectional view of the whole of a racking device using a nozzle.

The FIGS. 1A (a section along A—A in FIG. 1) and 1B are detailed views.

FIGS. 2A and 2B are partial sectional views which are intended to show the operation of the device of FIG. 1.

FIG. 1C shows a variant of the device of FIG. 1.

FIG. 3A and 3B are partial sectional views which are intended to show the operation of the device according to FIG. 3.

FIG. 1 shows a valve which is fitted out for racking using a nozzle.

Figure 3:
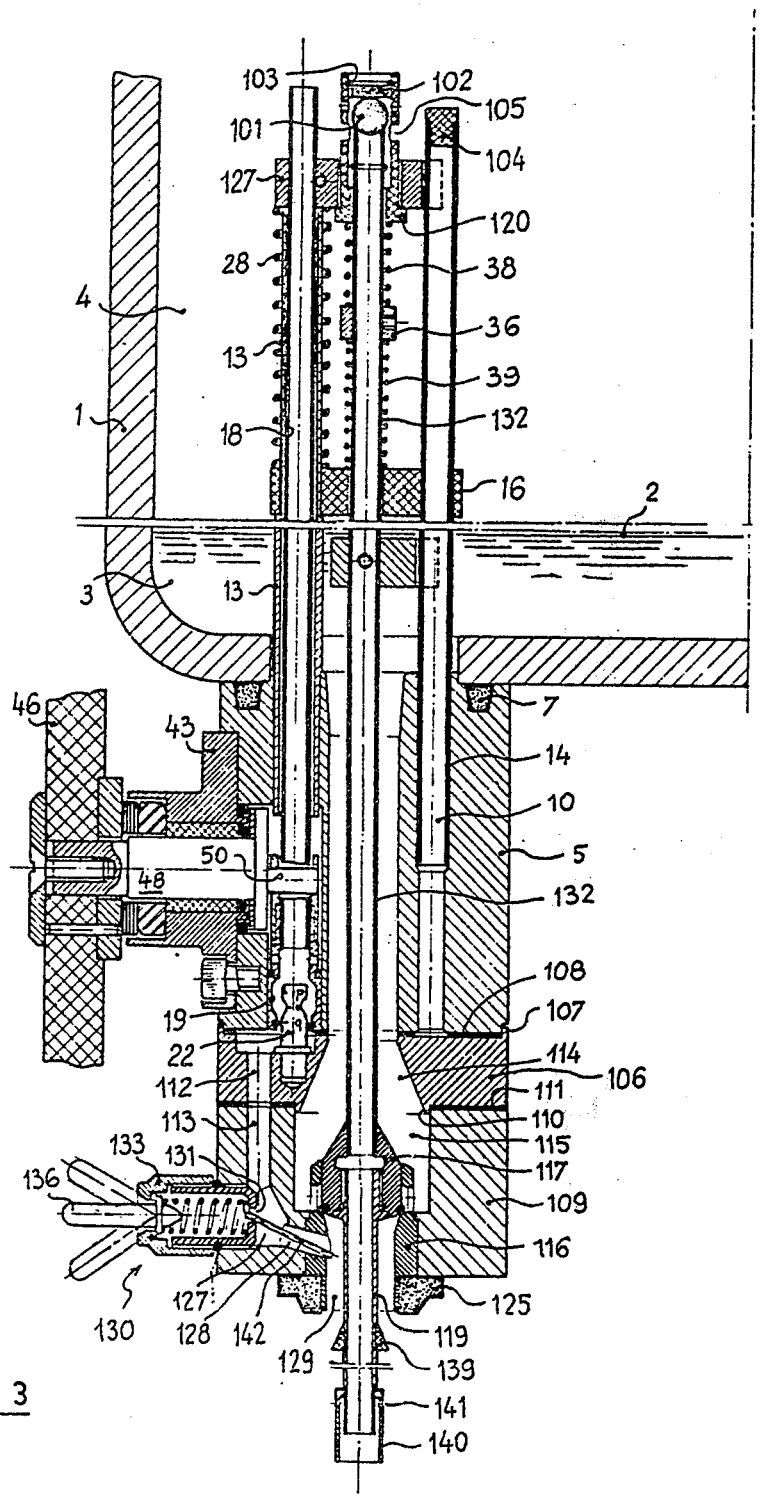
FIG. 3 is a sectional view of the whole of a racking device using lateral flow.

In FIG. 1 of the drawing the reference numeral 1 shows the tank of the racking device containing the liquid which is to be racked shown at 3 which reaches to a level 2 as well as the gas which is under pressure shown at 4.

In the case of a large capacity racking machine, the tank 1 has the shape of a hollow piece which is generally annular on which there are mounted a series of devices such as those shown in FIG. 1.

Each device consists of a valve body 5 of cylindrical shape which extends downwardly from the base of the tank 1 and which is fixed by appropriate means (clamps, flanges, etc.)

Centering of the body 5 on the tank 1 is obtained by means of a peripheral shoulder 6 on the upper part of the body 5 and sealing is provided for by a seal 7.

The body 5 has three channels 8, 9, 10 passing vertically through it; the channel 8 is for the purpose of pressurizing, the channel 9 is for the flow of liquid and the channel 10 is for return of gas.

A control unit 12 is located in a lateral opening 11 of the body 5.

The channel for pressurisation 8 and that for the return of gas 10 are extended upwardly into the tank 1 through the layer of liquid by the tube 13 and 14 which are pressed into and adhered to the body 2.

The extent to which the tube 13 is sunk in is limited by a peripheral shoulder 15.

One or more cross pieces 16 keep the tubes 13 and 14 parallel with respect to each other and provide for their rigidity.

The position of the upper cross piece 16 is determined by a shoulder 17 of the tube 13.

Inside the tube 8–13 a tube 18 is free to move which is extended downwardly by a slide valve 19 which engages around its lower end. Sealing pieces 20–21 provide for sealing between on the one hand the slide valve 19 and the valve body 5 and on the other hand between the slide valve 19 and a closure device 22 which is carried on a block 23 which is rigidly fixed to the body 5.

The closure device 22 has a particular shape in the sense that it includes two cylindrical portions between which a constriction towards the inside $22^1$ is located.

Holes 24, for example four in number are provided in the wall of the slide valve 19 slightly above the seal 20 in order to allow the circulation of liquid from the inside towards the outside or from the outside toward the inside of the slide valve.

Above the slide valve 19 a piece 25 in the shape of an avil is slipped freely around the tube 18 whose upper face acts an abutment on which a stud 50 which will be discussed below may act (FIG. 1B).

The tube 18 has fixed on it, in the tank 1, by means of a keeper pin 26, an arm 27 which is subject to the action of a spring 28 which is coiled around the tube 13 and is compressed between the arm 27 and the cross piece 16.

A bush 30 provided with a shoulder 31 which is capable of coming into contact with the lower face of the arm 27 is able to slide freely in a hole 29 which is provided in the central part of this arm (FIG. 1A).

This bush 30 is capable of motion about a stem 32 whch extends into the tank and then downwardly in the body 5 and which carries at its lower end a valve 33; on the top part this stem 32 carries above the arm 27 a groove in which there is located a sprung ring 34 on which an interior shoulder 35 of the bush 30 may act.

The stem 32 carries a ring 36 which is fixed by a screw 37 between the arm 27 and the upper cross piece 16. On both sides of this ring springs 38 and 39 are compressed which are situated around the stem 32.

The end lateral edge of the arm 27 faces a guide 40 which engages partially around the tube 14 (FIG. 1A).

The tube 14 for return of gas is closed at its upper end by a stopper 41 and is pierced in the region of the latter with a lateral opening 42 which allows the exit of gas.

The unit 12 includes a cover 43 fixed on the body 5 by means of screws 45 and is provided with a hole in which a bush 44 is housed.

The handle 46 of the unit is fixed by means of a screw 47 and a washer $47^1$ on a shaft 48 which extends in the hole of the bush 44.

At its end which is located at the side of the distributing device, the shaft 48 carries a plate 49 provided in an eccentric position with a stud 50 which is capable of acting on the abutment 25 in the shape of an anvil of the tube 18 (FIG. 1B).

Sealing between the cover 43 and the body 5 is provided for by a seal 51; a second seal 52 provides for sealing in the region of the bush 44.

The action of the anvil 46 as regards the effort for regulation may be controlled by means of a ring 53 in a synthetic material and a ring 54 in the form of a friction lining, both of these being arranged around the shaft 48.

The orientation of the handle 46 with respect to the shaft 48 is determined by two flats 55. A surface 56 for the friction lining is driven by the handle 46 by means of a keeper pin 57.

The action of the control mechanism can be adjusted by tightening of the screw 47 in order to increase the braking action of the friction lining 54 by compression of the ring 53 and a washer 58 in a synthetic material which is arranged between the sleeve 44 and the plate 49.

Centering of the block 23 is obtained using a small peripheral collar 59 which is provided on its upper edge while sealing with respect to the body 5 is provided for by a seal 60.

The channels 8, 9, 10 of the body 5 are extended by corresponding channels $8^1$,$9^1$, $10^1$ in block 23.

On its upper face and laterally with respect to the channel $8^1$ the block 23 carries the closure device 22 which allows the passage of a gas by the slide valve 19 only when the seal 21 is immobilised at level 0 (zero) (FIG. 2A). When this seal 21 is immobilised at levels 'p' or 'g' it is in contact with the cylindrical parts of the closure device 22 and the sealing of the slide valve 19 is ensured.

One important characteristic of the invention is that the channel $10^1$ is closed off by a ball 61 which rests on a seat 62 in a synthetic material located in the block 23.

A seal 63 provides a sealed seating for the valve 33. Guiding of the valve stem 32 is obtained using the holes which are provided in the cross pieces 16.

The bush 30 with its shoulder is capable of sliding freely in the central hole of the arm 27 and also allows the sliding of the valve stem 32.

Under the action of the spring 39 which is compressed between the ring 36 and the cross piece 16 raising of the valves 32–33 can be caused; however, as a result of the greater force of the spring 38, which is compressed between the bush 30 and the ring 36, the valve 32 33 is maintained on its seat 63.

When the bush 30 moves upwards, it causes the raising of the valve 32 33 when the shoulder 35 touches the spring washer 34.

A nozzle holder 64 is fixed on the block 23 with a flanged screw 65.

A seal 66 ensures sealing between the block 23 and the nozzle holder 64. The latter is pierced with three channels $8^2$, $9^2$, $10^2$ corresponding to the channels $8^1$, $9^1$, $10^1$ which are formed in the block 23. At the upper part the channels $8^2$–$10^2$ open into pipes 67 and 68 which are assembled by brazing on the nozzle holder 64 and provide for good orientation of the latter with respect to the block 23.

The channel $10^2$ is closed off towards the outside by a stopper 69; in this region the channel $10^2$ is formed in the shape of a bayonet.

A nozzle 70 and a tube for return of gas 71 are mounted on the nozzle holder 64 and are kept in position by brazing.

A pipe 72 is brazed on the upper opening of the nozzle 70 and completes the assembly; centering of the whole unit in hence provided for with respect to the block 23.

A bell shaped piece (not shown) is suspended from the nozzle holder 64 using a set of straps 73 which hinge on a socket (not shown).

Sealing between the nozzle holder 64 and the bush of the bell shaped piece is provided for by a seal 74.

Another seal which is not shown, provides for sealing between the mouth of the bottle and the bell shape piece.

The operation of this valve for racking using a nozzle is as follows:

A. Introduction of the bottle

When a bottle is brought to below the whole unit, this being provided for by a rising motion, its neck is automatically centered with respect to the nozzle by the conical entrance of the bell-shaped piece. During its rising, the bell shaped piece and the bottle are guided by the nozzle up to the point where the bell-shaped piece contact the seal 74 which is located at the lower part of the nozzle holder 64.

The bottle is hence in the position for racking and its sealing is provided for by the seal 74 and the seal between the bell-shaped piece and the neck of the bottle.

B. Pressurising the interior of the bottle (FIG. 2A)

The pressurising takes place using a gas under pressure which is located in the gas chamber which is above the level 2 of the liquid in the tank 1. It is controlled by a swinging of the handle 46 with the aid of a cam (not shown) which is placed at the periphery of the tank 1 which causes a slight rotation of the shaft 48 and of the eccentric stud 50 in such a way that the slide valve is freed from the action of this stud.

Under the action of the spring 28 the tube 18 and the slide valve 19 may then move slightly in the upward direction until the seal 21 takes up a position at level 0 of the closure device 22. The gas under pressure may from this point pass freely along the channel 8 and through the neck towards the inside of the bottle (FIG. 2A).

On the other hand, due to the rising of the tube 18 and of the arm 27 the effect of the spring 38 is cancelled out but the valve 33 remains on its seat due to the hydrostatic pressure of the liquid in the tank 1.

In this position, the bush 30 is also raised and the shoulder 35 comes into contact with the spring washer 34.

C. Opening for flow

This opening is controlled by a second cam which is situated at the periphery of the tank 1 and acts on the handle 46 so as to orientate it in such a way that the stud 50 completely frees the anvil 25 and allows the tube 18 and the slide valve 19 to continue to rise under the action of spring 28.

This second upward passage of the slide valve 19 is limited with precision by the lower edge of the tube 13 in such a way that the seal 21 becomes immobilised at level p of the closure device 22 (FIG. 2B).

The channel 8 for pressurisation is again closed at its lower end.

On the other hand, the raising of the tube 18 and of the arm 27 frees the bush 30 which is in contact with the spring washer 34 at its shoulder 35 and allows the valve stem 32 to rise under the influence of spring 39.

In the case where a bottle is chipped or explodes, the pressure in the container is not maintained, the spring 39 being suitably rated in order to become compressed; the valve 33 will be automatically maintained or brought back to its seat by the hydrostatic load which acts in the downwards direction.

Raising of the valve 33 allows flow of liquid through the nozzle 70 via the channel $9^2$.

Because of the isobarometric state between the tank 1 and the bottle, the liquid will flow smoothly under the effect of the pressure caused by the column of liquid under charge alone.

Moreover, as the nozzle 70 penetrates deep down into the bottle, the liquid will reach the bottom with the avoidance of turbulance which could give rise to loss of gas and the oxidation of the product.

During the flow of liquid, the gas contained in the bottle can ascend to the upper part of the tank 1 through the tube for return of gas 14, which is extended by the tube 71 via the channel $10^2$. The ball 61 raises itself slightly with the passage of the ascending gas flow and provides for circulation, in one sense only, of the pressurisation gas by the channel $10^1$–$10^2$.

The orifice 42 of the tube 14 deflects the rising flow through the channel 9 so as to avoid undesirable surges which could upset the correct operation of the pressurisation.

D. Termination of flow

At the end of filling, due to the principle of communicating vessels, the liquid penetrates into the tube 71 and has a tendency to rise up through the channel $10^2$.

However, according to our Archimedes principle and because of the increased resistance of the liquid flow, the ball 61 is carried upwardly and closes off the channel 10 when it comes to rest against a chamfered edge 75 of the body 5.

The ball 61 remains in this position due to the hydrostatic load which acts upwardly in the channel $10^1$ and the flow of liquid is stopped.

Moreover, the level of liquid in the bottle is stabilised at the level of the lower orifice of the tube 71. The whole of the gas space which exists in the neck and in the bell shaped piece acts as a damper in order to provide a progressive stopping which is nevertheless precise, of the flow.

It will also be noticed that the level of the lower orifice of tube 71 makes it possible to determine precisely the level of filling of the bottle.

E. Closing

When flow is stopped under the conditions which have been described above, it is appropriate to close the valve before the bottle is removed.

Another cam placed at the periphery of the tank 1 acts on the handle 46 to bring it once more back to its initial position so that the stud 50 causes the anvil 25 to descend which causes the tube 18 and the slide valve 19 to be pushed downwardly and the spring 28 to be compressed.

This new position of the handle 46 and the stud 50 determines the path of the slide valve 19 in such a way that the seal 21 is immobilised at the level q of the closure device 22 in order to maintain the sealing of the channel 8 for pressurisation.

On the other hand, the descent of the tube 18 and the arm 27 has the effect of compressing the springs 38 and 39 and bring the valve 33 to the seal at its seat 63.

F. Withdrawal of the bottle

As soon as the valve 33 has been brought back to its seat, the bottle can be removed. Prior decompression of the gas which remains in the neck of the bottle will not be necessary; actually, under normal conditions of pressure and of filling, this volume will be sufficient in order to damp in a progressive manner the decompression of the liquid at the time of withdrawal of the bottle.

It should be pointed out also that at the time of withdrawal of the nozzle 70, the latter carries with it its liquid content since its upper part is closed off by the valve 33 and that surface tension will prevent its drainage. It is necessary to take this into account in order to determine the level for the stopping of flow.

Figure 4:
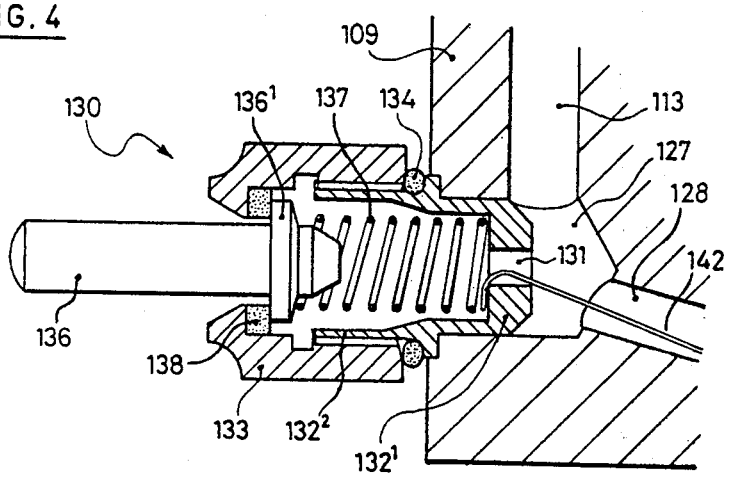
FIGS. 4 and 5 show details of the embodiments according to FIG. 3.

FIG. 1C shows as a variation an accessory fitting for the valve with the nozzle in which the channel 82 of the nozzle holder 64 is connected with a purging device 76 or device for bringing it to atmospheric pressure (known as "SNIFT") which may be of the type shown in FIG. 4. The gas which is able to escape from the bottle by this device when the latter is operated (for example using a supplementary cam) is advantageously recovered by a pipe 77 in a suitable reservoir 78 arranged on the outside of the racking machine.

FIG. 3 shows a valve which is adapted for racking by lateral flow (for example for lemonade mineral waters containing gas and other products where there is little danger of oxidation).

The stem 32 of FIG. 1 is replaced by a tube 132 which, at its upper part, can be closed off by a ball 101.

The bush 30 is extended upwardly (reference 120) beyond the tube 132 and is provided with a stopper 102 which is maintained in position by a spring washer 103.

In this embodiment, the tube 132 provides for the return gas in the place of tube 14 which now only has the purpose of guiding the moveable parts.

The tube 14 is closed off at its upper part by a stopper 104 whilst radial holes 105 are provided in the bush 120 for exit of gas.

A cross piece 106 is provided under the valve body 5 which is centered with respect to the body 5 by means of a small peripheral collar 107, which closes the channel 10 which is not used, while sealing is provided for by the seal 108.

A head 109 is provided under the cross piece 106 and is centered by a small interior collar 110 which is sealed by a seal 111.

In the cross piece 106 the channel for pressurisation 8 is extended by a channel 112 which is continued in the head 109 by a channel 113.

The cross piece 107 includes a central hollow 114 which is widened downwardly and is extended in the head 109 by a cavity 115.

Figure 5:
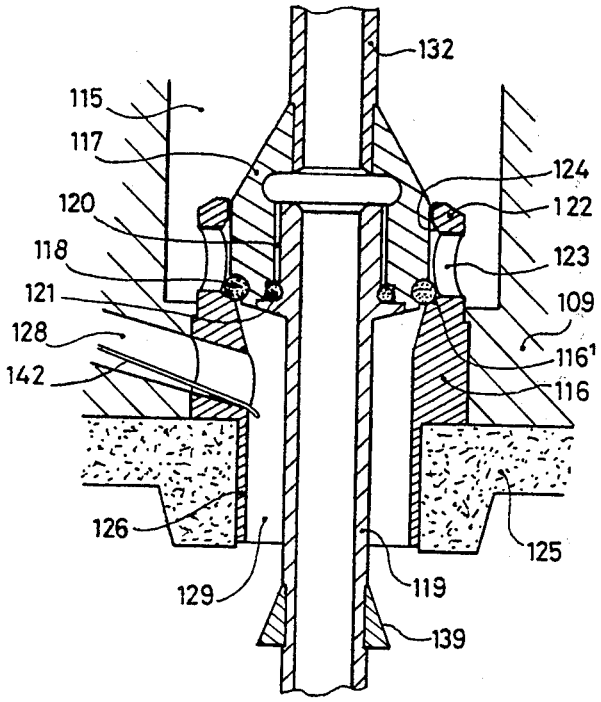

At its lower part the cavity 115 includes a tubular piece 116 (FIG. 5) which lines the interior surface of the head 109 and which forms a seat 116[1] for a valve 117 in the shape of a cup provided with a seal 118 and is fixed facing upwards on the tube 132; the latter is extended downwardly by a tube 119 for return of gas which is screwed onto a thread 120 of the valve 117. A seal 121 ensures sealing between the tube 119 for return of gas and the valve 117.

Piece 116 is extended upwardly by a sleeve 122 which is provided with radial holes 123 being for example eight in number which allow a flow of liquid and which includes an interior chamfered edge 124 which acts as a seat when the valve 117 is raised.

Sealing at the level of the neck of the bottle is obtained using a seal 125 which is provided around an extension 126 of the tubular piece 116.

The channel 113 (FIG. 3) discharges into a space 127 which is connected by a channel 128 with a chamber 129 for flow of liquid which is provided around the return tube 119.

On the other hand, the space 127 is in connection with a purging device 130 by a channel 131 which is formed in a flange 132[1] which is fixed in an opening of the head 109.

This flange 132[1] is extended outwardly by a threaded sleeve 132[2] on which a cap 133 is screwed (FIG. 4).

Sealing between the flange 132[1] and the cap 133 is obtained using a seal 134.

A lever 136 is retained in a central opening of the cap 133 and is maintained in position with respect to the cap by a flange 136[1] used in conjunction with a spring 137. A seal 138 provides for sealing between the flange 136[1] and the cap 133.

A stainless steel wire 142 is hooked in the orifice 131 of the purging device and extends through the channel 128 to the chamber 129.

The tube for return of gas 119, which is fixed at its upper part in the valve 117 carries towards its middle portion a deflector 139 (3) which has the purpose of orientating the flow of liquid and is provided at its lower part with a small tubular collar 140 in which radial orifices 141 are provided at the upper part. The tube 119 penetrates inside the small collar 140..

Operation of the valve adapted for racking by lateral flow

A. Introduction of the bottle

When a bottle is brought to below the unit it is moved with an ascending movement up to the point where its neck comes into abutment with the sealing joint 125.

B. Pressurisation of the inside of the bottle (FIG. 3A)

The pressurisation is controlled by a cam which is located at the periphery of the tank 1 which acts on the handle 46 in order to orientate it in such a way that the eccentric stud 50 frees the anvil 25 and allows the tube 18 and the slide valve 19 to rise due to the action of spring 28.

This new orientation of the handle 46 and the eccentric stud 50 determines the ascending path of the slide valve 19 in order that the seal 21 becomes immobilised at level O of the closure device 22.

The gas for pressurisation of the tank may thus penetrate into the bottle by the tube 18 and through the channels 112, 113, 128, which are provided in the pieces 108 and 109 via the constricted part 22[1] of the closure device 22.

On the other hand, the ascent of the tube 18 and of the arm 27 cancels out the effect of spring 38, but the valve 117 remains on its seat due to the hydrostatic pressure of the liquid in tank 1.

In this position, the bush 120 is also raised and the shoulder 35 comes into contact with the spring washer 34 while the stopper 102 frees the ball 101 which nevertheless remains on the tube 132 due to its own weight and the equilibrium of the pressures of the gases.

C. Opening for flow (FIG. 3D)

This opening is controlled by a second cam which is located at the periphery of the tank 1 and which acts on the handle 46 in order to orientate it in such a way that the eccentric stud 50 completely frees the anvil 25 and allows the tube 18 and the slide valve 19 to rise under the effect of spring 28.

This new ascending passage of the slide valve 19 is limited with precision by the lower end of tube 13 so that the seal 21 becomes immobilised at level p of the closure device 22.

The channel 8 for pressurisation is again closed off. On the other hand, the rising of tube 18 and of arm 27 frees the bush 120 which is in contact with the spring washer 34 at its shoulder 35 and allows the tube 132 and the valve 117 to rise due to the effect of spring 39.

In the case where a bottle is cracked or explodes, the pressure in the container is not maintained. The spring 39 which is suitably rated is able to become compressed and the valve 117 will be automatically maintained on or brought to its seat 116[1] by the hydrostatic load which acts downwardly. Raising of the valve 117 allows the flow of liquid by the channel 9 - 115 via the orifices 123 which are formed in the tubular extension 122 of the piece 116.

Because of isobarometric state between the tank 1 and the bottle, the liquid will flow smoothly under the effect of the pressure which is caused by the column of liquid under charge alone.

The deflector 139 which is positioned on the tube for return of gas 119 orientates the stream of liquid in order to direct the flow onto the interior wall of the bottle.

During flow of the liquid, the gas contained in the bottle may ascend to the upper part of the tank 1 by the tube 19 which is extended by tube 132.

The ball 101 is raised when there is passage of a rising gas flow and provides for one-way circulation of the gas which is being evacuated through the radial hole 105 of the bush 120.

D. Termination of flow

On completion of filling, due to the principle of communicating vessels, the liquid penetrates into the tube 119 and rises up in tube 132 until hydrostatic forces balance each other.

Surface tension will stop the flow at the level of the orifices 132 of the piece 116 while the seal 118 which is in contact with the chamfered edge 124 of the tubular extension 122 maintains the sealing at this level.

The level of liquid in the bottle becomes stationary at the level of the lower end of tube 119.

When the liquid has stopped flowing through the conduit 129, possible drainage of channel 128 and of the space 127 is obtained using the wire 132 which breaks the surface tension of the liquid at the level of the orifice of channel 128.

E. Shutting

When flow has been terminated under the conditions which have been described above, it is necessary to re-close the valve before withdrawing the bottle. A third cam which is located at the periphery of the tank 1 acts on the handle 46 to orientate it once more in its initial position in such a way that the eccentric stud 50 lowers the anvil 25 which causes the tube 18 and the slide valve 19 to move downwards and to compress the spring 28.

This new orientation of the handle 46 and of the stud 50 determines the passage of the slide valve 19 so that the seal 21 becomes immobilised at level q of the closure device 22 so as to maintain the sealing of the pressurisation channel.

On the other hand, the descent of tube 18 and of lever 27 has the effect of compressing the springs 38 and 39 and brings the valve 117 to its seat 116[1]. At the same time the stopper 102 keeps the ball 101 on the upper orifice of tube 132.

F. Decompression

In order to decompress the gas in the neck before removing the bottle, it is necessary to act on the lever 136 of the purging device 130 either by means of a final cam which is located on the periphery of the tank or better still by means of the handle 46 at the time of closing.

At the same time, the gas which is entrapped at the upper part of the return tube 132 expands and forces into the bottle the liquid which has ascended through this channel; in this way total drainage of the tube for return of gas is obtained even in the case where the liquid contains solid particles such as fruit pulp.

In order to avoid the bubbling of gas through the liquid due to the decompression of the gas contained in the tube 132 and 119, the small collar imprisons the gas pocket which is able to escape below the liquid level through the orifices 141 without upsetting the contents of the bottle.

G. Withdrawal of the bottle

Once the valve 117 is closed, the air from the neck of the bottle has been purged and the return tube has been emptied, the bottle may be withdrawn.

Such a purging device may be controlled either by a tangential force which is applied in any particular direction or even by an axial thrust which allows the operation of lever 136 using any particular appropriate device (among others the handle 46) and which also allows the user to direct the gas flow in the most advisable direction.

ADVANTAGES

Apart from the advantages which are associated with the aims which have been mentioned above and which relate to the small space which is occupied and the adaptation to particular usages, the supplementary results which are given below should be mentioned:

(a) a reduction of turbulance in the tank due to the simplification and the reduction in number of the parts which are immersed in the liquid;

(b) purging of the return channel for the gas is obviated;

(c) a reduction in the handling time for the bottles or containers thanks to the possible increase of the cross sectional path of the different liquids and the use of mechanism having regular and rapid action;

(d) all the parts are fully machined and may be in stainless steel; sealing is ensured by seals which can easily be replaced which leads to a decrease in cost price while still maintaining the necessary precision;

(e) in the case of fruit juices which increasingly contain pulp, there is no risk of blocking off the channel for return of gas, this being thanks to the absence of valves and to the large cross sectional areas which are provided for the passage of the liquid;

(f) in the case of FIG. 1, there is only a small amount of liquid which passes up through the channel 10 due to the ball 61 which, should liquid pass up through the channels 10[1] and 10[2], sticks against the chamfered edge 75;

(g) pressurisation is carried out in a way which is completely 'dry', the device for distribution of gas under pressure 19–22 being completely independent;

(h) purging carried out by means of the device 130 is completely dry thanks to the drainage by the wire 142 at the level of the orifice of channel 128;

(i) the control cams which act on the unit 12 do not need to be precise thanks to the tolerances which are admissible when immobilising the slide valve 19 at the level 'o' 'p' 'q' of the closure device 22;

(j) a reduction in disturbance of liquid flow at the time of drainage of the return channel 132 and 119 thanks to the small collar 140 which allows the decompression of the gas above the level of the liquid.

I claim:

1. In a plant for the isobarometric racking of liquid and filling of bottles under gaseous pressure the said plant comprising a rotating tank containing the liquid to be racked and the gas under pressure and on which are mounted a series of valve devices each for the filling of one separate bottle, each valve device consisting of a valve body which is fixed to the tank, extends downwardly from the base of the tank and has three conduits passing vertically through it and extending upwards through the liquid in the tank to the upper zone in the tank which forms a gas pressure where gas under pressure is contained, said first conduit conducts gas under pressure, said second conduit conducts the flow of liquid and said third conduit returns the gases, the improvement being that a device is situated in the said tank for the control of the opening of the flow of liquid and inside the gas pressure conduit a slidably mounted tube is coaxially and internally mounted said sliding tube having at the lower extremity a distributor consisting of a slide valve which extends the sliding tube downwards and a closing means coaxially connected with the said valve body and resting on said closing means said slide valve is manipulated by a mechanical control means, said valve and said closing means cooperating in such a way that by a succession of actions of said mechanical control means on the said slide valve, said slide valve and said closing means are brought into relative positions of sealing and of passage of gas under pressure and the sliding of said sliding tube is caused and in that a mechanically linked opening means is provided between the said sliding tube and the said control device in the upper zone of the tank for opening of the flow of liquid in such a manner that the movements of the sliding tube are caused to determine the opening of the flow.

2. A plant according to claim 1, characterized in that sealing joints are carried by a block which is rigidly fixed to the valve body between the slide valve and the valve body and also between the slide valve and said closing means, said closing means is made up of two cylindrical parts which are separated by a constricted part and in that mechanical control means are provided whereby said slide valve and said closure device are adapted to be brought in two relative sealing positions at different levels and in a position at an intermediate level in which the passage of the gas under pressure is allowed.

3. Plant according to claim 2, characterized in that above the slide valve a piece is slipped freely around the sliding tube, one upper face of said piece having an abutment on which a stud which is an element of said mechanical control device.

4. Plant according to claim 2 characterized in that the tank there is fixed on the sliding tube an arm which is spring based and said spring is coiled around the gas under pressure conduit and is compressed between said arm and a cross piece for the three conduits situated in the tank and in that a stem carrying in the valve body a valve for the control of the flow of liquid, is located in a passage through said arm a sliding bush is free to slide around this sliding bush being provided with a shoulder which is cooperable with the lower face of said arm.

5. Plant according to claim 4, characterized in that said stem carrying the valve for the control of the liquid flow is provided with an annular member responsive to the action of an interior shoulder of said sliding bush such that, in a first path of the sliding tube and said arm fixed to the sliding tube in the tank, the control valve for the flow of liquid is positioned on a seat in the valve body by the action of a spring coiled on the said stem between the said sliding bush and a ring fixed on the stem that during a second path the action of said spring is cancelled to cause the flow control valve to open under the action of a spring coiled around the stem between the said ring and a cross-piece in the tank.

6. Plant according to claim 5, characterised in that the tube for return of gases is closed off at its upper end by a stopper and has passing through it in the region of the latter a lateral opening for exit of gases.

7. Plant according to claim 3, characterized in that the control unit consists of a cover fixed on the valve body and provided with a shaft which carries a plate provided in an eccentric position with said stud adapted to act on the piece mounted on the sliding tube arranged in the gas under pressure conduit.

8. Plant according to claim 7, in which the channel in the valve body for the return of gas under pressure comprises a widening portion comprising an upper seat and a lower seat between which a ball is adapted to slide.

9. Plant according to claim 8, in which during the flow of liquid the gas contained in the bottle is adapted to ascend at the upper zone of the tank through the return tube, the ball situated in the widening portion being slightly raised from its seat by gas under pressure and in the case of a bottle being broken or absent the said ball rests on the lower seat whereby an automatic closure of the return gas channel is insured.

10. Plant according to claim 9, characterized in that when the flow of liquid has stopped, the said control device is operated upon and is oriented into its initial position such that said stud causes a downward movement of said sliding tube and said slide valve, a seal being then immobilized at the level of said closing means in a position to maintain the sealing of the under pressure gas channel.

11. Plant according to claim 2, characterized in that it is executed for the racking by lateral flow, that the stem carrying said flow control valve is replaced by a tube for the return of gases, in that the sliding bush is extended beyond upwards the latter tube and is closed by a ball and with a spring stopper and in that radially arranged openings are provided in the tube for the es cape of gases.

12. Plant according to claim 11, characterized in that a cross piece is provided under the valve body which closes off the return gas tube which is not being used and in that under the said cross-piece there is a head provided with channel in the extension of the gas pressure conduit.

13. Plant according to claim 12, characterized in that the cross piece includes a central hollow which is extended in the said head by a cavity at the lower part of which a tubular piece is provided which covers the interior face of the head and which forms a seat for a valve which is fixed on the return gas tube which latter is extended downwardly by a tube for return of gases mounted on the said valve, the said tubular piece being extended upwardly by a sleeve which has radial holes through which the flow of liquid is allowed and which includes an interior chamfered edge.

14. Plant according to claim 13, characterized in that the sleeve forms a guide for the said valve when displaced upwards and downwards between the opening and closing positions.

15. Plant according to claim 14, characterized in that the said valve is provided at its lower part with joint which comes in contact in closing position against a seat of the tubular piece and in the opening position against the chamfered edge.

16. Plant according to claim 12, characterized in that the tube for conveying gas under pressure opens into a space in connection with a purging device including a channel which is formed in a base fixed in an opening of the said head, said base extending towards the exterior in the form of a threaded sleeve on which a cap is screwed and in that in a hole a lever is retained which is maintained by means of its flange against the cap by a spring and which may be submitted to the action of a cam.

17. Plant according to claim 16, characterized in that a wire is hung in the channel of the purging device which extends through the channel for flow of liquid to a chamber which is provided around the tube for return gas.

18. Plant according to claim 17, characterized in that the tube for return of gases is provided at its lower end with a small tubular collar in which radial orifices are provided at the top part, the tube penetrating inside a small collar.

* * * * *